United States Patent [19]

Browning

[11] Patent Number: 4,739,745

[45] Date of Patent: Apr. 26, 1988

[54] CIRCULAR DIAMOND SAW BLADE INCORPORATING A NOVEL CUTTING SEGMENT

[75] Inventor: Robert E. Browning, Montpelier, Vt.

[73] Assignee: N E D Corp., Worcester, Mass.

[21] Appl. No.: 736,620

[22] Filed: May 21, 1985

[51] Int. Cl.[4] ..... B28D 1/04

[52] U.S. Cl. ..... 125/15; 51/206 R

[58] Field of Search ..... 125/15, 18; 51/206 R, 51/164.5

[56] References Cited

U.S. PATENT DOCUMENTS

| | | | |
|---|---|---|---|
| 2,978,850 | 4/1961 | Gleszer | 51/164.5 |
| 3,016,661 | 1/1962 | Nielsen | 125/15 |
| 3,338,230 | 8/1967 | Lindblad | 125/15 |
| 4,337,750 | 7/1982 | Dutcher | 51/206 R |

FOREIGN PATENT DOCUMENTS

| | | | |
|---|---|---|---|
| 557223 | 5/1957 | Belgium | 125/15 |

*Primary Examiner*—Harold D. Whitehead

*Attorney, Agent, or Firm*—S. Pal Asija

[57] ABSTRACT

An improved diamond abrasive saw blade comprising a steel disc having a plurality of slots and resultant projections at its periphery and a plurality of 'L' or 'T' shaped cutting segments affixed alternatingly in line inversed to each other at the periphery of said disc is described. Also described is a method of retrofitting prior art worn out used blades with novel cutting segments of this invention.

4 Claims, 2 Drawing Sheets

CIRCULAR DIAMOND SAW BLADE INCORPORATING A NOVEL CUTTING SEGMENT

PRIOR ART

The best prior art known to the inventor is as follows:

| | | |
|---|---|---|
| Lindblad | 3,338,230 | Aug. 29, 1967 |
| Dutcher | 4,337,750 | Jul. 06, 1982 |
| Schwarykopf et al. | 3,863,401 | Feb. 04, 1975 |
| Benson | 3,128,755 | Apr. 14, 1964 |
| Metzger | 3,127,887 | Apr. 07, 1964 |

The applicant's invention and the above cited prior art inventions relate to abrasive circular saw type blades for cutting non-metallic materials such as stone, concrete, ceramic, lime, etc. More particularly these inventions relate to abrasive saw blades of the type in which plurality of diamond segments are bonded at the periphery of a slotted steel disc or core. These blades are made in different diameters and present several problems all affecting efficiency and per cut cost.

The prior art devices have one or more of the following characteristics.

(a) High tool cost per cut area.
(b) Imprecise or poor quality cuts.
(c) Limited or low productivity.
(d) Poor coolant efficiency.
(e) High power consumption.
(f) High wear and tear on the machinery.
(g) Limited Steel Core Life due to high cutting pressures.
(h) Ability to make only a limited depth of cut.
(i) In adequate swarf removal.

Here are various standard prior art solutions which solve one or more of the above problems.

(a) To decrease productivity which improves (a), (b), (d), (g), (h), and (i), but worsens (c), (e), and (f).

(b) To decrease the bond or matirx hardness for an equal diamond concentration. This increases the tool cost but more or less improves everything else.

(c) To decrease the size or cutting surface of the standard rectangular segment which worsens cut quality and may raise tool costs.

(d) To increase the diamond concentration of the cutting segments or elements. This may improve the cut quality, but unfortunately increases the cost.

(e) To increase the horse power and the RPM (Revolutions Per Minute) of the motor. This can improve productivity but worsens everything else.

(f) To increase the coolant supply and coolant quality (by using additives). While this solution does improve all the factors, it does so only to a small degree.

OBJECTIVES

The principal objective of the applicants invention to increase efficiency, and reduce per cut cost without adverse affect on any other aspect of the operation.

Another objective of the applicant's invention is to improve the coolant distribution and efficiency.

Another objective is to increase the life of the steel core for comparable applications.

Another objective is to improve the precision and quality of the cut, assuming all other factors are comparable.

Another objective of the applicants invention is to reduce power consumption.

Another objective of the applicant's invention is to reduce wear and tear on the machinery or in other words to increase the longevity of the machinery.

Another objective of the applicants invention is to provide increased resistance to undercutting problems.

Another objective of the applicants invention is to improve swarf removal.

Another objective of this invention is that the improved diamond cutting segments or elements of this invention can be retrofitted onto prior art blades or steel discs, commonly called "retipping".

Other objects of this invention reside in its simplicity, elegance of the solution, bonding of cutting segments to steel core, general machine operating procedures, human factors and aesthetics as will become apparent from the following description.

SUMMARY

The applicants solution which may appear obvious in retrospect is to reduce the surface contact between the cutting surface and the work surface which allows freer or easier cutting: also coupled with its particular design increases the coolant efficiency. It is obvious that this solution does not require increased diamond concentration, increased coolant, softer matrix, horsepower, RPM, electrical consumption or the like.

Schwarykopf discloses uniformly serrated cutting surface with almost 50% of the segments surface area in contact with the steel disc, while in the applicants invention, only approximately 10% of the total surface area of the cutting segment or element is in contact with the steel disc and the remaining 90% is in contact with the coolant, this of course also contributes to the improved coolant efficiency.

The applicant achieves this by designing and affixing cutting segments which are wider than the steel disc thickness and have additional surface area by virtue of the design in the shape of L, I, T or H or Inverted T or Inverted L, or the like configuration.

With increased coolant flow to the cutting element, and decreased friction or drag it is possible to achieve greater efficiency, reduce per cut cost, without increasing RPM (Revolutions Per Minute) of the blade or diamond content of the cutting elements assuming other factors are comparable.

DETAILED DESCRIPTION OF THE PREFERRED EMBODIMENT

Figure 1:
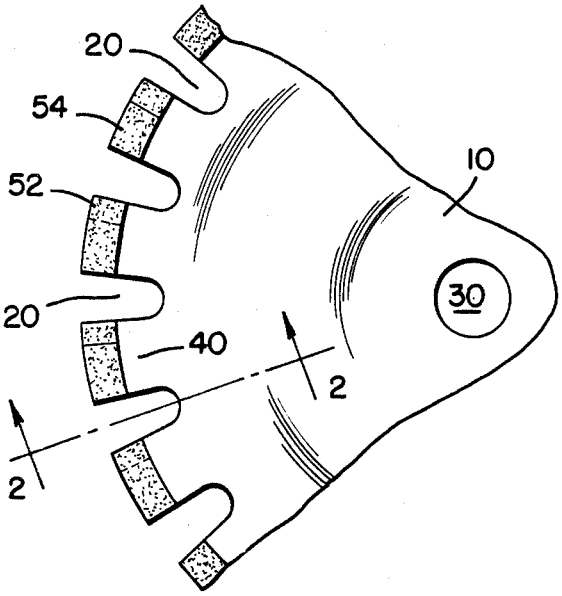
FIG. 1 is a side elevational view of a section of the circular diamond saw blade of this invention having L shaped cutting segments of FIG. 5.

As shown in the side elevational view of FIG. 1, a typical diamond circular saw blade of this invention comprises a circular steel disc or core of several feet in diameter having thickness fraction of an inch. The disc has plurality of slots (20) and center hole (30) for mounting on the motor shaft.

Diamond blade segments are then made from composition typically containing cobalt, tungsten carbide, various alloys, and up to 20% diamond particles or grit.

These segments are normally rectangular in shape but also can be L, T, I, or H as shown in FIGS. 5, 6, 7, & 8, respectively.

These segments are then welded or brazed on to the periphery of the steel disc, perpendicular to the plane of the disc such that the short side 52 of the L alternatingly faces in the opposite direction.

The segments being larger than the thickness of the disc extend beyond the thickness of the disc. Portions of long side 54 as well as short side 52 extend beyond the thickness of the disc, as can be readily seen in FIG. 9, which is a view along diameter of diamond saw blade of FIG. 1 having L shaped segments of FIG. 5.

Figure 3:
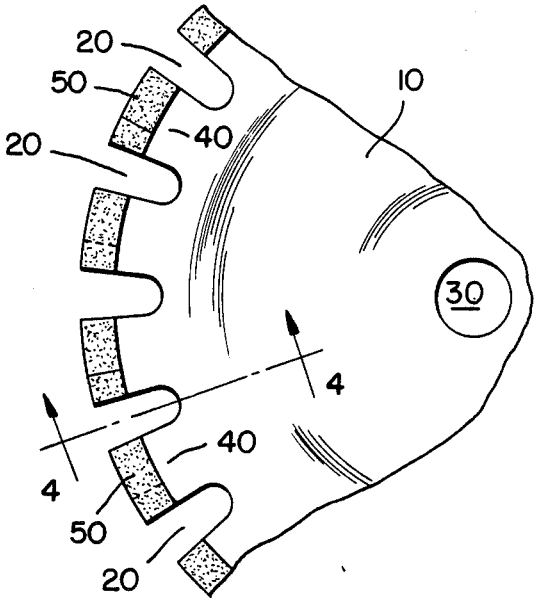
FIG. 3 is side elevational view of a section of the circular diamond saw blade of this invention having the L shaped diamond abrasive cutting segments/elements mounted in the opposite direction.
Figure 2:
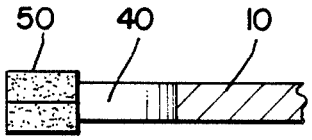
FIG. 2 is a sectional view taken along the plane of the lines 2—2 of FIG. 1 looking in the direction of the arrows.
Figure 4:
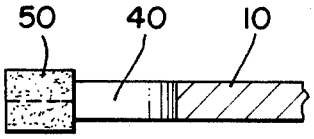
FIG. 4 is a sectional view taken generally along lines 4—4 of FIG. 3 while looking in the direction of the arrows.
Figure 5:
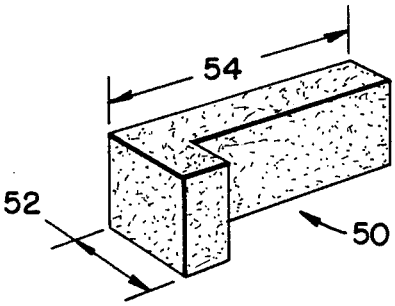
FIG. 5 is an embodiment of the diamond cutting segment or element.
Figure 6:
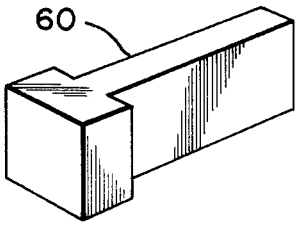
FIG. 6 is an alternate embodiment of the diamond cutting segment or element.
Figure 7:
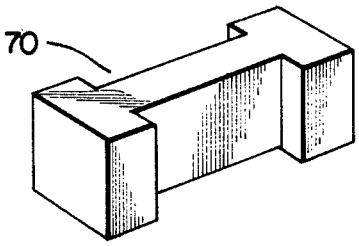
FIG. 7 is another alternate embodiment of the diamond cutting segment or element.
Figure 8:
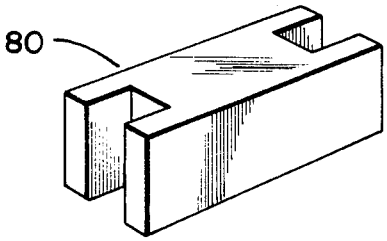
FIG. 8 is yet another embodiment of the diamond cutting segment or element.
Figure 9:
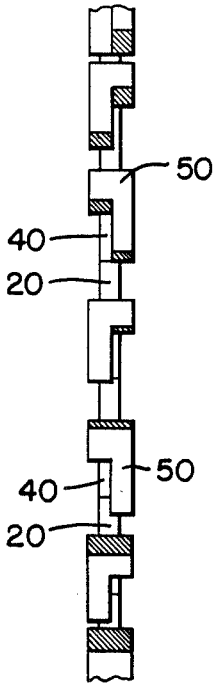
FIG. 9 is a view along diameter of the diamond saw blade of FIG. 1 having L shaped segments of FIG. 5.
Figure 10:
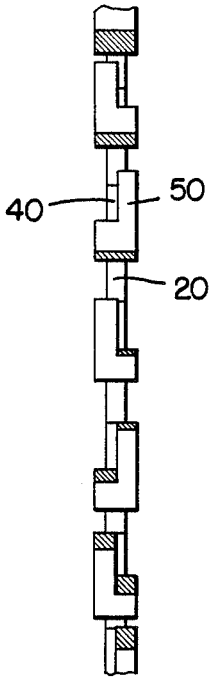
FIG. 10 is a view along diameter of diamond of FIG. 3 having L shaped segments of FIG. 5 mounted in the opposite direction to that of FIG. 1 but still perpendicular to the plane of the steel disc.

FIGS. 3, 4, & 10 are like FIGS. 1, 2, & 9 respectively, except that the L shaped segments are mounted in the opposite direction to that of FIG. 1 but still perpendicular to the plane of the disc and still alternatingly in the opposite direction. This in turn provides balance and symmetry.

Optionally, the slots 20 may be filled after the segments have been welded on unnotched areas 40, but this is not recommnded in the preferred embodiment as it has adverse affect on the cooling of the diamond cutting segment.

Following is a list of the components used in the preferred embodiments arranged in an ascending order of the reference numerals. This list, however, is not necessarily complete with respect to components but does list all reference numerals used.

10 Circular steel disc or core of varying diameters but only fractions of an inch thick.

20 Slots on the periphery of the steel disc 10.

30 Holes at the center of the steel disc suitable for mounting the disc on the motor shaft.

40 Unslotted sections of the discs periphery or land.

50 L Shaped cutting element or segment containing diamond grit.

52 Short side of L.

54 Long side of L.

60 T shaped cutting element.

70 I shaped cutting element.

80 H shaped cutting element.

In the foregoing description the inventor has described the essence of his invention without confusing a person of average skill in the art with unnecessary detail. Many changes may be made without deviating from the spirit of this invention. Examples of such variation include but are not limited to the following.

These segments may be mounted on the steel disc in a manner other than the 2 alternating methods already described in FIGS. 9 & 10.

(a) The composition of the cutting elements of segments may be improved or otherwise modified.

(b) The shape of the cutting elements may be changed.

(c) Fixation of the cutting segments to the steel disc may be by means other than welding.

(d) The shap of the slots may be varied or even eliminated.

(e) The dimensions of the disc may be changed.

(f) Material of the disc may be varied.

(g) Application of the diamond saw blade may be changed.

Having thus described the invention, what the inventor wishes to protect by U.S. Patent is as follows.

The inventor claims:

1. An improved diamond abrasive saw blade comprising a steel disc having plurality of slots and resultant projections at its periphery and a plurality of L shaped cutting segments affixed alternatingly in line inversed to each other at the periphery of said disc.

2. An improved diamond abrasive saw blade of the type having a plurality of cutting elements mounted at the periphery of a steel disc wherein the improvement is characterized by:

(a) the cutting element has more than 6 surfaces;

(b) the width of the cutting element is larger than the width of the disc;

(c) the surface area in contact with the disc is less than the exposed surface area of cutting element; and (d) wherein said cutting elements are 'L' shaped and are mounted alternatingly in line inversed to each other.

3. An improved diamond abrasive saw blade of the type having a plurality of cutting elements mounted at the periphery of a steel disc wherein the improvement is characterized by:

(a) the cutting element has more than 6 surfaces;

(b) the width of the cutting element is larger than the width of the disc;

(c) the surface area in contact with the disc is less than the exposed surface area of cutting element-;and (d) wherein said cutting segments are 'T' shaped and are mounted alternatingly in line inversed to each other.

4. An improved diamond abrasive saw blade of the type having plurality of cutting elements or segments mounted at the periphery of of a steel disc where the improvement is characcterized by:

(a) the cutting segments have more than 6 surfaces;

(b) the width of the cutting segments is larger than the width of the disc;

(c) the surface area in contact with the disc is less than the exposed surface area of the cutting segment;

(d) the cutting segments are alternatingly mounted in line inversed to each other; and (e) wherein said cutting segments are 'L' shaped.

* * * * *